US012742615B2

(12) United States Patent
Engblom

(10) Patent No.: US 12,742,615 B2
(45) Date of Patent: Sep. 22, 2026

(54) MINE SAFETY ARRANGEMENT AND METHOD FOR FACILITATING MINE SAFE OPERATION OF A VEHICLE

(71) Applicant: BAE Systems Hägglunds Aktiebolag, Örnsköldsvik (SE)

(72) Inventor: Daniel Engblom, Bonässund (SE)

(73) Assignee: BAE Systems Hägglunds Aktiebolag, Örnsköldsvik (SE)

( * ) Notice: Subject to any disclaimer, the term of this patent is extended or adjusted under 35 U.S.C. 154(b) by 340 days.

(21) Appl. No.: 18/564,511

(22) PCT Filed: May 10, 2022

(86) PCT No.: PCT/SE2022/050459

§ 371 (c)(1),
(2) Date: Nov. 27, 2023

(87) PCT Pub. No.: WO2022/255917

PCT Pub. Date: Dec. 8, 2022

(65) Prior Publication Data

US 2024/0183640 A1 Jun. 6, 2024

(30) Foreign Application Priority Data

Jun. 1, 2021 (SE) ..... 2150701-7

(51) Int. Cl.
*F41H 7/04* (2006.01)
*F42B 33/06* (2006.01)

(52) U.S. Cl.
CPC ..... *F41H 7/042* (2013.01); *F42B 33/065* (2013.01)

(58) Field of Classification Search
CPC ..... F41H 7/044
See application file for complete search history.

(56) References Cited

U.S. PATENT DOCUMENTS 6,292,727 B1 * 9/2001 Norton ..... B60R 21/01556 701/45
2002/0195806 A1 * 12/2002 Thomas ..... B60R 21/01538 280/735

(Continued)

FOREIGN PATENT DOCUMENTS

| | | |
|---|---|---|
| EA | 029991 B1 | 6/2018 |
| WO | 2016/015877 A1 | 2/2016 |
| WO | 2020/106249 A1 | 5/2020 |

OTHER PUBLICATIONS

Extended European Search Report dated Mar. 25, 2025, directed to EP Application No. 22816540.3; 4 pages.

(Continued)

*Primary Examiner* — Mark A Shabman
(74) *Attorney, Agent, or Firm* — Morrison & Foerster LLP

(57) ABSTRACT

A mine safety arrangement and a method for facilitating mine safe operation of a vehicle is provided. The vehicle includes a vehicle body and a vehicle body connected ground engaging arrangement for moving the vehicle. The vehicle body also includes a bottom portion and an inner space having a floor portion associated with the bottom portion. The inner space includes a mine safe level at a predetermined distance from the floor portion. Persons housed in the inner space having all body portions at or above the mine safe level are expected to be safe should the vehicle be subjected to a mine. The mine safety arrangement includes a sensor arrangement configured to provide signals at the mine safe level so that body portions crossing the mine safe level are detected by the signals for alerting persons that body portions crossed the mine safe level.

11 Claims, 4 Drawing Sheets

(56) References Cited

U.S. PATENT DOCUMENTS

| | | | | |
|---|---|---|---|---|
| 2005/0264082 | A1 | 12/2005 | Kumpf | |
| 2009/0072606 | A1 | 3/2009 | Haberecht | |
| 2011/0079134 | A1 | 4/2011 | Jacquemont | |
| 2012/0111181 | A1 | 5/2012 | Brill | |
| 2014/0007761 | A1* | 1/2014 | Haidar | B60N 2/24 89/36.01 |
| 2014/0096672 | A1* | 4/2014 | Ames | F41H 7/046 89/902 |
| 2014/0216238 | A1* | 8/2014 | Pfennig | F41H 5/02 89/36.02 |
| 2016/0275795 | A1* | 9/2016 | Lippman | B60T 7/12 |
| 2018/0297489 | A1* | 10/2018 | Szawarski | B60N 2/067 |
| 2020/0142396 | A1* | 5/2020 | Youmans | G01M 1/08 |

OTHER PUBLICATIONS

International Search Report and Written Opinion mailed Jun. 9, 2022, directed to International Application No. PCT/SE2022/050459; 13 pages.

Office Action dated Jan. 11, 2022 directed to SE Application No. 2150701-7; 9 pages.

* cited by examiner

MINE SAFETY ARRANGEMENT AND METHOD FOR FACILITATING MINE SAFE OPERATION OF A VEHICLE

CROSS-REFERENCE TO RELATED APPLICATIONS

This application is a U.S. national stage application under 35 U.S.C. § 371 of International Application No. PCT/SE2022/050459, filed May 10, 2022, which claims the priority of SE Application No. 2150701-7, filed Jun. 1, 2021. The entire contents of each priority application is incorporated herein by reference.

FIELD OF THE DISCLOSURE

The present invention relates to a mine safety arrangement of a vehicle. The present invention also relates to method for facilitating mine safe operation of a vehicle. The present invention also relates to a vehicle.

BACKGROUND OF THE DISCLOSURE

Vehicles operating in certain regions such as military zones and in certain operational situations may be subjected to mines in the terrain. Such vehicles may be arranged to transport passengers. Such vehicles may be military tracked vehicles, e.g. articulated tracked vehicles. Such vehicles comprise a vehicle body and a ground engaging arrangement, e.g. track assembly pairs, for moving the vehicle, connected to said vehicle body. The vehicle body comprises a bottom portion and an inner space for housing passengers, said inner space having a floor portion associated with said bottom portion. The inner space comprises a mine safe level at a predetermined distance from said floor portion. If the vehicle is driving over a mine resulting in the mine exploding, the bottom portion will be affected such that the floor portion is bent towards said mine safe level. Persons housed in said inner space above said mine safe level are expected to be safe. However, a person having at least a portion of the body below said mine safe level may be seriously injured. By adding an inner mine floor, this risk may be eliminated. Such a solution will however reduce the inner space.

There is thus a need for providing mine safety arrangement of a vehicle, which arrangement facilitates mine safe operation of the vehicle without the need of such adaption of the vehicle body.

OBJECTS OF THE INVENTION

An object of the present invention is to provide a mine safety arrangement of a vehicle, which facilitates mine safe operation of the vehicle without the need of adaption of the vehicle body.

Another object of the present invention is to provide a method for mine safe operation of a vehicle without the need of adaption of the vehicle body.

Another object of the present invention is to provide a vehicle with such a mine safety arrangement.

SUMMARY OF THE DISCLOSURE

These and other objects, apparent from the following description, are achieved by a mine safety arrangement of a vehicle, a method for mine safe operation and a vehicle as set out in the appended independent claims. Preferred embodiments of the arrangement and method are defined in appended dependent claims.

Specifically an object of the invention is achieved by a mine safety arrangement of a vehicle. Said vehicle comprises a vehicle body and a ground engaging arrangement for facilitating moving the vehicle. Said ground engaging arrangement is connected to said vehicle body. Said vehicle body comprises a bottom portion and an inner space for housing passengers. Said inner space has a floor portion associated with said bottom portion. Said inner space comprises a mine safe level at a predetermined distance from said floor portion. Persons housed in said inner space and being positioned with all body portions at or above said mine safe level are expected to be safe should the vehicle be subjected to a mine under said bottom portion affecting said floor portion. Said mine safety arrangement comprises a sensor arrangement configured to provide one or more signals at said mine safe level so that body portions crossing said mine safe level are detected by means of said one or more signals, for alerting persons of the mine safety risk. Thus, persons housed in said inner space and being positioned with all body portions at or above said mine safe level are expected to be safe if the vehicle is subjected to a mine under said bottom portion affecting said floor portion. Thus, said sensor arrangement is configured to provide one or more signals at said mine safe level so that body portions crossing said mine safe level are detected by means of said one or more signals, for alerting persons that one or more body portions have crossed said mine safe level. According to an aspect, said mine safe level is a predetermined level determined e.g. based on mine tests performed on a corresponding vehicle/vehicle body/body portion and/or based on mine simulations/estimations/calculations of configuration of such a vehicle/vehicle body/body portion. According to an aspect, said mine safe level is based on a predetermined ground clearance of said bottom portion and said predetermined distance from said floor portion. According to an aspect, said predetermined distance from said floor portion of said mine safe level is based on the ground clearance of said bottom portion. According to an aspect, said predetermined mine safe level is associated with the expected deformation of said bottom portion if a mine would explode underneath said bottom portion of said vehicle body. By thus providing such signals at said mine safe level, mine safe operation of the vehicle without the need of adaption of the vehicle body is facilitated.

According to an embodiment of said mine safety arrangement, said one or more signals configured to be provided by said sensor arrangement are one or more light beams. By thus providing light beams at said mine safe level, easy detection of a body portion having crossed the mine safe level for that person, in that the person can see a light reflection on that body portion.

According to an embodiment of said mine safety arrangement, said one or more light beams are laser beams. By thus providing laser beams at said mine safe level, easy detection of a body portion having crossed the mine safe level for that person, in that the person could see a laser reflection on that body portion.

According to an embodiment of said mine safety arrangement, said sensor arrangement comprises at least one signal emitting unit arranged within said inner space so as to facilitate providing said one or more signals at said mine safe level. Hereby efficient provision of signals, e.g. light beams, in desired direction may be provided, so as to facilitate detection of body portions crossing the mine safe level.

According to an embodiment said mine safety arrangement is further configured to, based on a detected body portion, provide a visual warning and/or an audial warning and/or a tactile warning. Hereby persons in said space having one or more body portions crossing said mine safe level would be efficiently warned. Thus, hereby safety is further improved.

According to an embodiment of said mine safety arrangement, said mine safe level is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

Specifically an object of the invention is achieved by a method for facilitating mine safe operation of a vehicle. Said vehicle comprises a vehicle body and a ground engaging arrangement for facilitating moving the vehicle. Said ground engaging arrangement is connected to said vehicle body. Said vehicle body comprises a bottom portion and an inner space for housing passengers. Said inner space has a floor portion associated with said bottom portion. Said inner space comprises a mine safe level at a predetermined distance from said floor portion. Persons housed in said inner space and being positioned with all body portions at or above said mine safe level are expected to be safe should the vehicle be subjected to a mine under said bottom portion affecting said floor portion. Said method comprises the steps of: providing one or more signals at said mine safe level; and, detecting, by means of said one or more signals, body portions crossing said mine safe level for alerting persons of the mine safety risk. Thus, persons housed in said inner space and being positioned with all body portions at or above said mine safe level are expected to be safe if the vehicle is subjected to a mine under said bottom portion affecting said floor portion. Thus, said method comprises the steps of: providing one or more signals at said mine safe level; and, detecting, by means of said one or more signals, body portions crossing said mine safe level for alerting persons that one or more body portions have crossed said mine safe level.

According to an embodiment of the method, said one or more provided signals are one or more light beams.

According to an embodiment of the method, said one or more light beams are laser beams.

According to an embodiment the method further comprises the step of, based on a detected body portion, providing a visual warning and/or an audial warning and/or a tactile warning.

According to an embodiment of the method, said mine safe level is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

The method for facilitating mine safe operation of a vehicle according to the present disclosure has the advantages according to the corresponding mine safety arrangement as set out herein.

Specifically an object of the invention is achieved by a vehicle comprising a mine safety arrangement as set out herein.

According to an embodiment said vehicle is a tracked vehicle. According to an alternative embodiment said vehicle is a wheeled vehicle.

BRIEF DESCRIPTION OF THE FIGURES

For a better understanding of the present disclosure reference is made to the following detailed description when read in conjunction with the accompanying drawings, wherein like reference characters refer to like parts throughout the several views, and in which.

DETAILED DESCRIPTION OF THE DISCLOSURE

Herein the term "link" refers to a communication link which may be a physical connector, such as an optoelectronic communication wire, or a non-physical connector such as a wireless connection, for example a radio or microwave link.

Herein the term "mine safe level", associated with a vehicle comprising a vehicle body and a vehicle body connected ground engaging arrangement for facilitating movement of the vehicle, where said vehicle body has a bottom portion configured to be arranged at a distance from the ground on which said ground engaging arrangement is configured to be engaged so as to provide a ground clearance, and an inner space with a floor portion associated with said bottom portion, refers to a level in said inner space being at such a distance from said floor portion, in a direction away from the ground, that persons housed within said space with all body portions at or above said level, would not be severely affected, if a mine would explode under said bottom portion of said vehicle body, in that damage to the bottom portion would not affect the floor portion so that the floor portion would reach said level within said space.

Figure 1A:
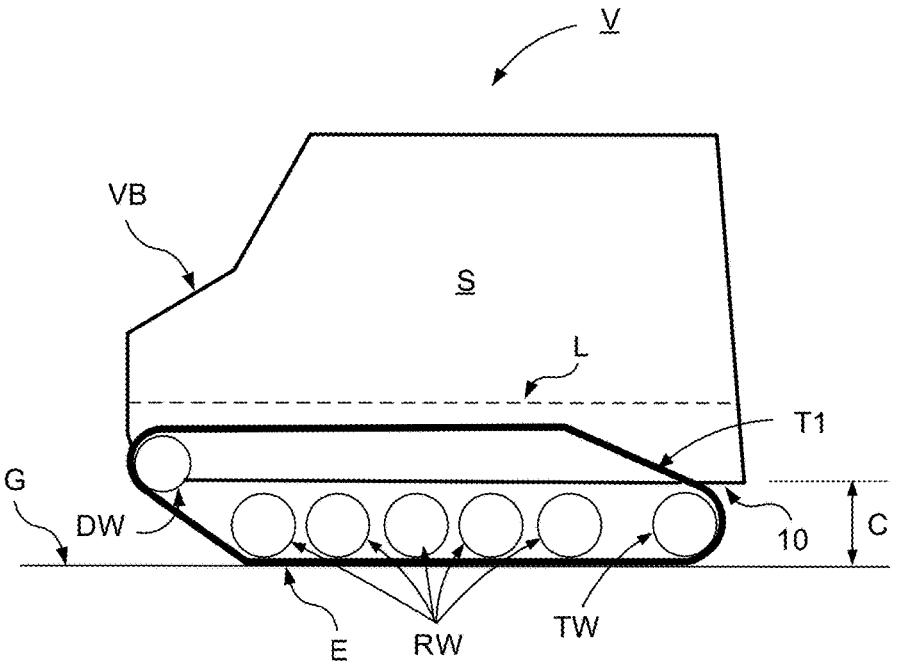
FIG. 1A schematically illustrates a side view of a tracked vehicle according to an embodiment of the present disclosure.

FIG. 1A schematically illustrates a side view of a tracked vehicle V according to an embodiment of the present disclosure.

The tracked vehicle V comprises a vehicle body VB, which according to an aspect of the present disclosure comprises the chassis of the vehicle V and bodywork.

The tracked vehicle V comprises a ground engaging arrangement T1 configured to engage with the ground G on which the vehicle V is intended to travel for facilitating moving the vehicle V. Said ground engaging arrangement T1, for said tracked vehicle V, comprises or is provided by a track assembly pair.

Said track assembly pair comprises a left track assembly T1 and a right track assembly for driving the vehicle V, the left track assembly T1 being shown in FIG. 1A. Said ground engaging arrangement T1 in the shape of said track assemblies T1 is configured to be connected to said vehicle body VB. Said track assemblies T1 are configured to be suspendedly connected to said vehicle body VB.

Said vehicle body VB comprises an inner space S for housing passengers. Said vehicle body VB comprises a bottom portion 10. Said vehicle body VB is configured to be arranged at a certain distance from the ground for providing a certain ground clearance. According to an aspect of the present disclosure the vehicle may be configured such that said ground clearance may be adapted, e.g. based on operation situation. According to an aspect of the present disclosure, a predetermined ground clearance is provided when operating in zones/regions/situations where there may be mines. According to an aspect of the present disclosure, said bottom portion 10 is configured to be at predetermined distance C from said ground G when operating in a zone/region/area/situation where there is a risk for being subjected to mines.

Said inner space S has a floor portion associated with said bottom portion 10. Said inner space S comprises a mine safe level L at a predetermined distance from said floor portion. Said predetermined mine safe level L may be determined by performing tests on a corresponding vehicle/vehicle body/bottom portion and/or simulations/estimations/calculations based on configuration of such a vehicle/vehicle body/bottom portion.

Thus, according to an aspect of the present disclosure, said mine safe level L is a predetermined mine safe level.

According to an aspect of the present disclosure, said mine safe level L is a predetermined level determined based on mine tests performed on one or more of: a corresponding vehicle, a corresponding vehicle body and a corresponding bottom portion. According to an aspect of the present disclosure, such mine tests refers to tests on a corresponding vehicle, a corresponding vehicle body and/or a corresponding bottom portion, were a mine arranged underneath such a bottom portion and allowed to explode, wherein the deformation of said bottom portion and the level at which portions of said floor portion of said bottom portion, due to associated movement of portions of said floor portion in connection to said deformation of said bottom portion, is noted.

According to an aspect of the present disclosure, said mine safe level L is a predetermined level determined based one simulations, estimations and/or calculations of explosion of a mine on a configuration of such a vehicle, configuration of such a vehicle body and/or configuration of such a bottom portion. According to an aspect of the present disclosure, such simulations, estimations and/or calculations refers to simulations, estimations and/or calculations, were a mine arranged underneath such a bottom portion and allowed to explode, wherein the deformation of said bottom portion and the level at which portions of said floor portion of said bottom portion, due to associated movement of portions of said floor portion in connection to said deformation of said bottom portion, is simulated, estimated and/or calculated. According to an aspect, said mine safe level L is based on a predetermined ground clearance of said bottom portion 10 and said predetermined distance from said floor portion 12.

According to an aspect, said predetermined distance from said floor portion 12 of said mine safe level is based on the ground clearance of said bottom portion 10.

According to an aspect, said predetermined mine safe level L is associated with the expected deformation of said bottom portion 10 if a mine would explode underneath said bottom portion of said vehicle body VB.

Persons P housed in said inner space S and being positioned with all body portions at or above said mine safe level L are expected to be safe should the vehicle be subjected to a mine exploding under said bottom portion 10. Thus, persons P housed in said inner space S and being positioned with all body portions at or above said mine safe level L are expected to be safe if the vehicle is subjected to a mine under said bottom portion affecting said floor portion 10.

Each track assembly comprises a drive wheel DW, a tension wheel TW, a set of road wheels RW and an endless track E arranged to run over said wheels. The endless track E is thus arranged to be disposed around said wheels. Here the drive wheel DW is arranged in the front, the tension wheel TW is arranged in the back and the road wheels RW are arranged between the drive wheel DW and the tension wheel TW. The tracked vehicle according to the present disclosure may however have track assemblies with any suitable arrangement of drive wheel, tension wheel and road wheels. According to an aspect of the present disclosure the tension wheel may be arranged in the front, the drive wheel arranged in the back and the road wheels arranged there between.

The endless track E of the respective track assembly is arranged to be driven and hence rotated by means of said drive wheel DW. The vehicle V comprises a drive arrangement, not shown, for driving said drive wheels. The drive arrangement may be any suitable drive arrangement. The drive arrangement may comprise any suitable drive means such as an internal combustion engine and/or an electric machine.

Figure 1B:
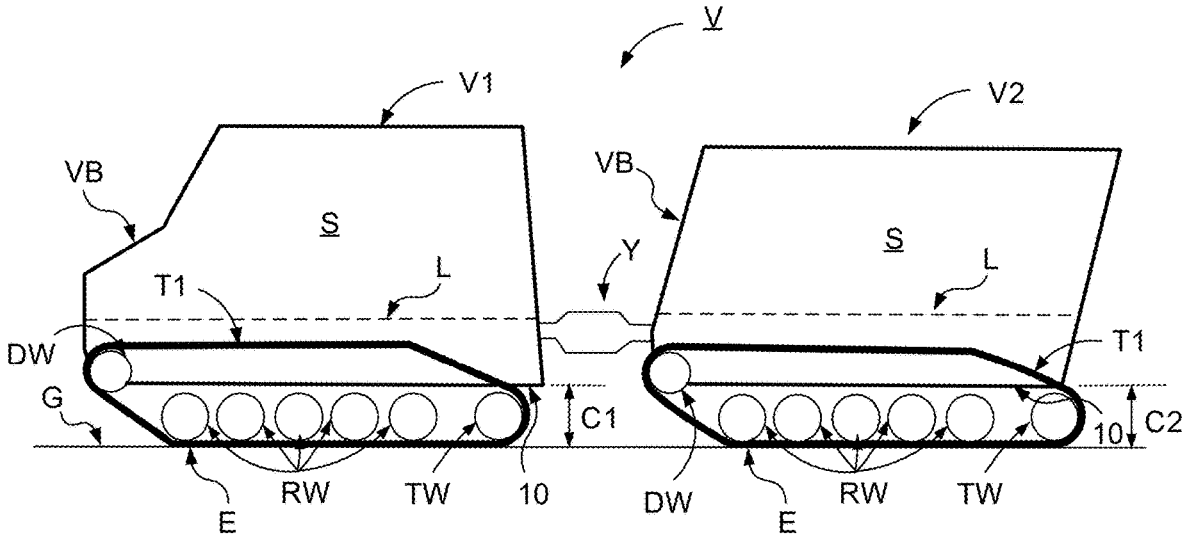
FIG. 1B schematically illustrates a perspective view of an articulated tracked vehicle according to an embodiment of the present disclosure.

FIG. 1B schematically illustrates a side view of a tracked vehicle V according to an embodiment of the present disclosure.

Said tracked vehicle V is an articulated tracked vehicle V comprising a first vehicle unit V1 and a second vehicle unit V2 pivotably connected to the first vehicle unit V1 via an articulation joint Y.

The respective vehicle unit V1, V2 of the tracked vehicle V comprises a vehicle body VB, which according to an aspect of the present disclosure comprises the chassis of the vehicle V and bodywork.

The first vehicle unit V1 and a second vehicle unit V2, i.e. tracked vehicle V, comprises a ground engaging arrangement T1 configured to engage with the ground G on which the vehicle units V1, V2 of the vehicle V are intended to travel for facilitating moving the vehicle V. Said ground engaging arrangement T1, for said tracked vehicle V, comprises or is provided by a track assembly pair for the respective vehicle unit.

Said track assembly pair comprises a left track assembly T1 and a right track assembly for the respective vehicle unit V1, V2 of the vehicle V, the left track assembly T1 being shown in FIG. 1B. Said ground engaging arrangement T1 in the shape of said track assemblies T1 is configured to be connected to the vehicle body VB of the respective vehicle unit V1, V2. Said track assemblies T1 are configured to be suspendedly connected to the vehicle body VB of the respective vehicle unit V1, V2.

The vehicle body VB of the respective vehicle unit V1, V2 comprises an inner space S for housing passengers. The vehicle body VB of the respective vehicle unit V1, V2 comprises a bottom portion 10. The vehicle body VB of the respective vehicle unit V1, V2 is configured to be arranged at a certain distance C1, C2 from the ground G for providing a certain ground clearance. According to an aspect of the present disclosure the vehicle may be configured such that said ground clearance may be adapted, e.g. based on operation situation. According to an aspect of the present disclosure, a predetermined ground clearance is provided when operating in zones/regions/situations where there may be mines. According to an aspect of the present disclosure, the bottom portion 10 of the respective vehicle unit V1, V2 is configured to be at predetermined distance C1, C2 from said ground G when operating in a zone/region/area/situation where there is a risk for being subjected to mines.

The inner space S of the respective vehicle unit V1, V2 has a floor portion associated with said bottom portion 10. The inner space S of the first vehicle unit V1 and/or the second vehicle unit V2 comprises a mine safe level L at a predetermined distance from said floor portion. Said predetermined mine safe level L may be determined by performing tests on a corresponding vehicle/vehicle body/bottom portion and/or simulations/estimations/calculations based on configuration of such a vehicle/vehicle body/bottom portion.

Persons P housed in said inner space S and being positioned with all body portions at or above said mine safe level L are expected to be safe should the vehicle be subjected to a mine exploding under said bottom portion 10. Thus, persons P housed in said inner space S and being positioned with all body portions at or above said mine safe level L are expected to be safe if the vehicle is subjected to a mine under said bottom portion affecting said floor portion 10.

Each track assembly comprises a drive wheel DW, a tension wheel TW, a set of road wheels RW and an endless track E arranged to run over said wheels. The endless track E is thus arranged to be disposed around said wheels. Here the drive wheel DW is arranged in the front, the tension wheel TW is arranged in the back and the road wheels RW are arranged between the drive wheel DW and the tension wheel TW.

The endless track E of the respective track assembly of the respective vehicle unit V1, V2 of said tracked vehicle V is arranged to be driven and hence rotated by means of said drive wheel DW.

The vehicle V comprises a drive arrangement, not shown, for driving said drive wheels. The drive arrangement may be any suitable drive arrangement. The drive arrangement may comprise any suitable drive means such as an internal combustion engine and/or an electric machine. The respective track assembly T1 of the vehicle units V1, V2 of said tracked vehicle V may comprise a drive arrangement for operating and hence driving said drive wheels DW.

As illustrated in FIG. 1A and FIG. 1B the vehicle V according to the present disclosure may be a single tracked vehicle as in FIG. 1*a* or an articulated tracked vehicle V with a front vehicle unit V1 and a rear vehicle unit V2 pivotably connected to the front vehicle unit V1.

As illustrated in FIG. 1A and FIG. 1B the vehicle V according to the present disclosure may be a tracked vehicle with a ground engaging arrangement comprising track assemblies with endless tracks configured to engage with the ground for driving the vehicle. According to an alternative, not shown, the vehicle according to the present disclosure may be a wheeled vehicle with a ground engaging arrangement comprising a set of wheels configured to engage with the ground for driving the vehicle.

Figure 2:
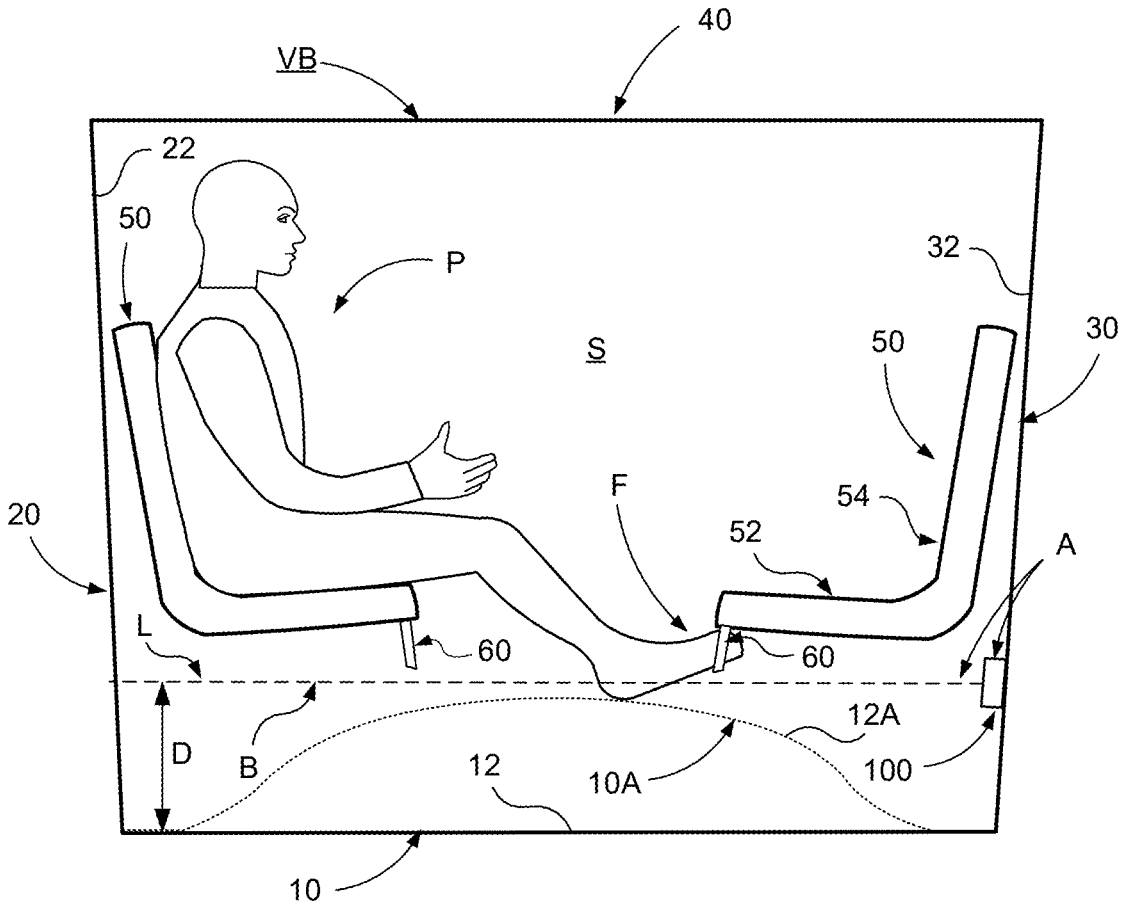
FIG. 2 schematically illustrates a rear view of a vehicle body with a mine safety arrangement according to an embodiment of the present disclosure.
Figure 3:
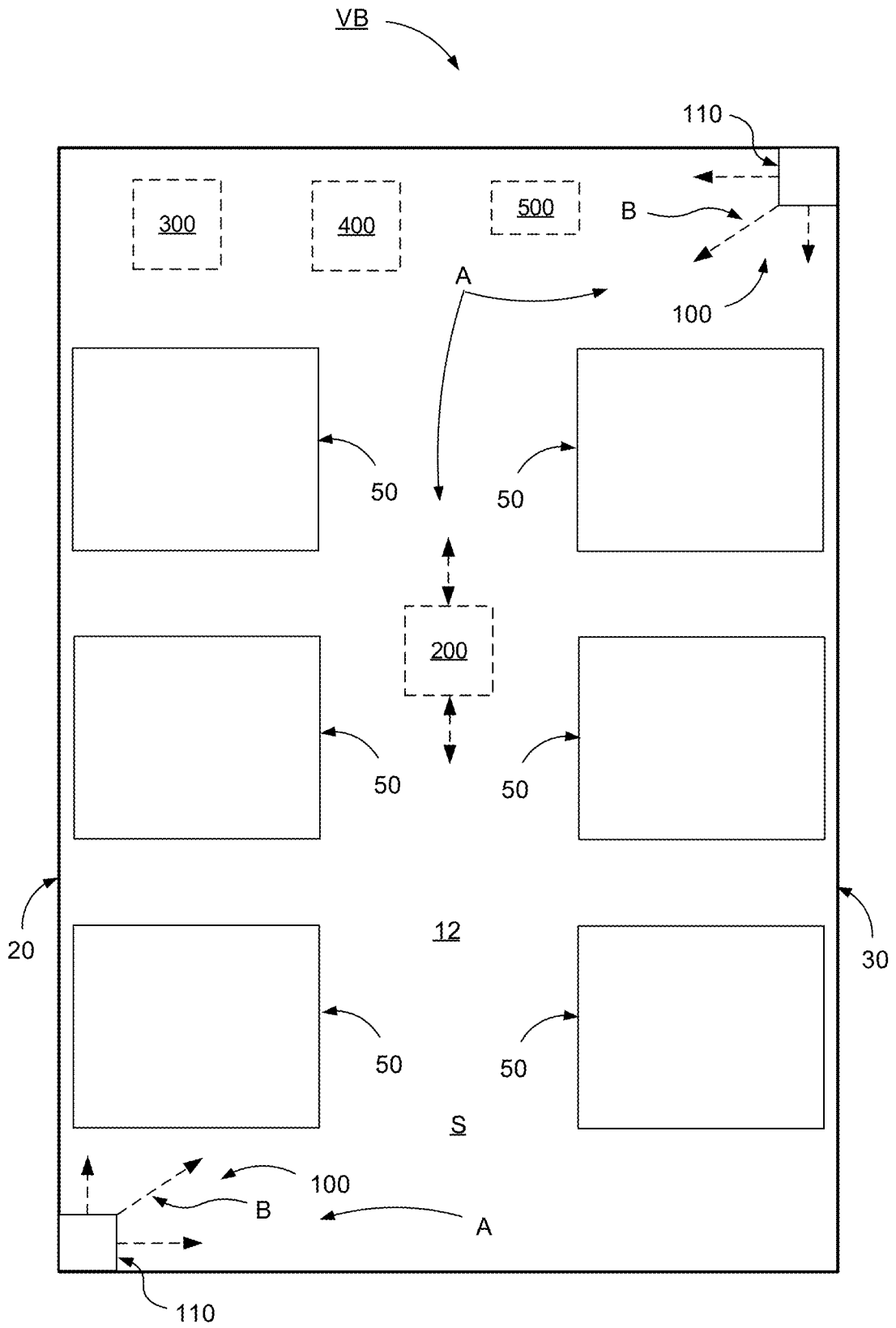
FIG. 3 schematically illustrates a plan view of a vehicle body with a mine safety arrangement according to an embodiment of the present disclosure; and, FIG. 4 schematically illustrates a flowchart of a method for facilitating mine safe operation of a vehicle according to an embodiment of the present disclosure.

FIG. 2 schematically illustrates a rear view of a vehicle body VB with a mine safety arrangement according to an embodiment of the present disclosure; and FIG. 3 schematically illustrates a plan view of a vehicle body with a mine safety arrangement according to an embodiment of the present disclosure.

Said vehicle body VB may be a vehicle body VB according to the vehicle V in FIG. 1A. Said vehicle body VB may be a vehicle body VB according to e.g. the second vehicle unit V2 according to FIG. 1B. Said vehicle body VB may a vehicle body for a military vehicle. Said vehicle body VB may be a vehicle body VB for transporting passengers. Said vehicle body VB may a vehicle body for in FIGS. 2 and 3 may be a vehicle body for a vehicle with any suitable ground engaging arrangement for moving the vehicle, and thus said vehicle body VB may a vehicle body for a tracked vehicle or a wheeled vehicle.

The vehicle of the vehicle body VB comprises a ground engaging arrangement, not shown, for facilitating moving the vehicle, said ground engaging arrangement being configured to be connected to said vehicle body VB.

Said vehicle body VB comprises a bottom portion 10. Said vehicle body VB further comprises opposite side portions 20, 30 and atop portion 40, and front and rear portions, said bottom portion 10, side portions 20, 30, top portion 40 and front and rear portions forms a housing portion of the vehicle body VB.

Said vehicle body VB comprises an inner space S for housing passengers. Said bottom portion 10, side portions 20, 30, top portion 40 and front and rear portions are configured to form said inner space S. Said side portions 20, 30 comprises a left side portion 20 and a right side portion 30. Said inner space S comprises a left inner wall portion 22 associated with said left side portion 20 and an opposite right inner wall portion 32 associated with said right side portion 30.

Said inner space has a floor portion 12 associated with said bottom portion 10. Said inner space S comprises a mine safe level L at a predetermined distance D from said floor portion 12.

Persons P housed in said inner space S and being positioned with all body portions at or above said mine safe level L are expected to be safe should the vehicle be subjected to a mine under said bottom portion 10 affecting said floor portion 12. Thus, persons P housed in said inner space and being positioned with all body portions at or above said mine safe level L are expected to be safe if the vehicle is subjected to a mine under said bottom portion 10 affecting said floor portion 12.

According to an aspect of the present disclosure, said bottom portion 10 of said vehicle body VB is configured such that said bottom portion 10, if mine explodes underneath said vehicle body VB, i.e. under said bottom portion 10, the bottom portion 10 will deform upwardly such that a deformed bottom portion 10A with a deformed associated floor portion 12A is obtained. The floor portion 12A of the deformed bottom portion 10A will, at certain areas within the inner space S move closer to said mine safe level L.

According to an aspect of the present disclosure, seat members 50 for said passengers P are arranged within said space S. According to an aspect of the present disclosure, said seat members 50 are arranged within said inner space S along said respective side portion 20, 30, in connection to said inner wall portions 22, 32 of said side portions 20, 30.

Said seat member 50 may be any suitable seat member. Said seat member 50 comprises a seat portion 52 for the passenger to sit on, and may according to an aspect comprise a backrest 54.

According to an aspect of the present disclosure, said seat members 50 are fixedly arranged to said inner wall portions 22, 32 of said side portions 20, 30.

According to an aspect of the present disclosure, said seat members 50 are configured to be arranged in connection to said inner wall portions 22, 32 of said side portions 20, 30 so that seat portions 52 are arranged above said mine safe level L.

According to an aspect of the present disclosure, said seat members 50 are arranged along said respective side portion 20, 30, in connection to said inner wall portions 22, 32 of said side portions 20, 30 so that individual seat members 50 distributed along said inner wall portion 22 associated with said left side portion 20 and individual seat members 50 distributed along said inner wall portion 32 associated with said right side portion 30 are arranged opposite to each other so that they face each other. Thus, a seat member 50 arranged in connection to said inner wall portion 22 is configured to face a seat member 50 arranged in connection to said opposite inner wall portion 32.

According to an aspect of the present disclosure, support members 60 for said passengers P are arranged within said space S for providing support of body portions so as to facilitate keeping body portions, e.g. feet F, above said mine safe level L.

According to an aspect of the present disclosure, said support members 60 are configured to be arranged in connection to seat portions 52 of said seat member 50 so that the feet F of a person P being positioned in a seat member 50 may supported by a support member 60 arranged in connection to an opposite seat member 50, see FIG. 2. Said support members 60 may according to an aspect comprise a loop configuration for sticking in toes/portion of foot F. Such a support member 60 may be arranged underneath said seat portions of the respective seat member 50, but above said mine safe level L. Such a support member 60 may however, depending on size of foot and/or how the foot F is held in connection to said support member 60, result in portion of the foot F, e.g. heal, ending up below said mine safe level L.

The present disclosure comprises a mine safety arrangement A. Said mine safety arrangement A comprises a sensor arrangement 100 configured to provide one or more signals B at said mine safe level L so that body portions crossing said mine safe level L are detected by means of said one or more signals B for alerting persons P of the mine safety risk.

According to an aspect of the present disclosure, said one or more signals B configured to be provided by said sensor arrangement 100 are visible signals. According to an aspect of the present disclosure, said one or more signals B configured to be provided by said sensor arrangement 100 are one or more light beams B. According to an aspect of the present disclosure, said one or more light beams B are laser beams.

According to an aspect of the present disclosure, said sensor arrangement 100 comprises at least one signal emitting unit 110 arranged within said inner space S so as to facilitate providing said one or more signals at said mine safe level L.

According to an aspect of the present disclosure, said at least one signal emitting unit 110 arranged within said inner space S are configured to provide signals B, e.g. light beams such as laser beams B, at said mine safe level L in connection to said support member 60 so as to detect body portions, e.g. feet, crossing said mine safe level L in connection to a support member 60.

According to an aspect of the present disclosure, said at least one signal emitting unit 110 comprises one or more laser emitting units configured to emit one or more laser beams. According to an aspect of the present disclosure, said one or more laser emitting units are configured to emit one or more narrow coherent laser beams of visible light configured to illuminate body portions crossing said mine safe level L with a bright spot of coloured light. According to an aspect of the present disclosure, said one or more laser emitting units may comprise one or more laser pointers.

According to an aspect of the present disclosure, said mine safety arrangement A is further configured to, based on a detected body portion, provide a visual warning and/or audial warning and/or tactile warning. According to an aspect of the present disclosure, said mine safety arrangement A is further configured to, based on a detected body portion by means of said sensor arrangement 100, provide a visual warning and/or an audial warning and/or a tactile warning.

According to an aspect of the present disclosure, said at least one signal emitting unit 110 is configured to, based on if a body portion crosses one or more emitted signal, provide a visual warning and/or an audial warning and/or a tactile warning. According to an embodiment said at least one signal emitting unit 110 may comprise or be operably connected to a control device configured to receive information associated with body portions crossing emitted signal(s) on said mine safe level and take action so as to inform persons crossing said emitted signal(s) with one or more body portions and/or other persons in the vicinity of such persons.

According to an aspect of the present disclosure, said mine safety arrangement A comprises a visual warning device, not shown, configured to provide said visual warning. Said visual warning may be activation of a light or the like. According to an aspect of the present disclosure, such a visual warning device may be arranged to be activated if the body portion crossing said one or more emitted signals is not removed within a predetermined time interval.

According to an aspect of the present disclosure, said mine safety arrangement A comprises an audial warning device, not shown, configured to provide said audial warning. Said audial warning may be activation of an alarm or the like. According to an aspect of the present disclosure, such an audial warning device may be arranged to be activated if the body portion crossing said one or more emitted signals is not removed within a predetermined time interval.

According to an aspect of the present disclosure, said mine safety arrangement A comprises a tactile warning device, not shown. Said tactile warning may be said one or more signals generating a temperature change, e.g. heat, on a body portion crossing said one or more signals, or a shock or the like. According to an aspect of the present disclosure, such a tactile warning device may be arranged to be activated if the body portion crossing said one or more emitted signals is not removed within a predetermined time interval.

According to an aspect of the present disclosure, said mine safety arrangement A comprises a control device 200. Said control device 200 may comprise one or more control units. According to an aspect of the present disclosure, said control device 200 is operably connected to said sensor arrangement 100. According to an aspect of the present disclosure, said control device 200 is configured to be operably connected to said sensor arrangement 100 via one or more links. Such a control device 200 is schematically illustrated in FIG. 3.

According to an aspect of the present disclosure, said control device 200 is configured to receive information from said sensor arrangement 100 associated with body portions crossing emitted signal(s) on said mine safe level. According to an aspect of the present disclosure, said control device 200 is configured to take action so as to inform persons crossing said emitted signal(s) with one or more body portions and/or other persons in the vicinity of such persons.

According to an aspect of the present disclosure, said control device 200 comprises or is operably connected to a visual warning device configured to provide a visual warning.

According to an aspect of the present disclosure, said control device 200 comprises or is operably connected to an audial warning device configured to provide an audial warning.

According to an aspect of the present disclosure, said control device 200 comprises or is operably connected a tactile warning device configured to provide a tactile warning.

According to an aspect of the present disclosure, said mine safety arrangement A comprises a ground clearance determination device 300 configured to determine the ground clearance of the vehicle. According to an aspect of the present disclosure, said control device 200 comprises or is operably connected to the ground clearance determination device 300 configured to determine the ground clearance of the vehicle. According to an aspect of the present disclosure, said control device 200 is configured to receive information about current ground clearance from said ground clearance determination device 300. Said ground clearance determination device 300 may comprise one or more sensors for detecting the position of the vehicle body of said vehicle relative to the ground. Such one or more sensors may comprise one or more distance determination sensors and/or one or more sensors associated with detecting the position of the vehicle body relative to the ground engaging arrangement of the vehicle.

According to an aspect of the present disclosure, if said vehicle is operating or is intended to operate in one or more of a zone, a region an area, and a situation where there is a risk for being subjected to mines, said control device 200 is configured to take action based on received information about current ground clearance from said ground clearance determination device 300 so that the bottom portion of the vehicle body of the vehicle is at a predetermined distance from the ground, and thus such that a predetermined ground clearance of the vehicle is applied.

According to an aspect of the present disclosure, if said vehicle is operating or is intended to operate in one or more of a zone, a region an area, and a situation where there is a risk for being subjected to mines, said control device 200 is configured to determine, based on received information about current ground clearance from said ground clearance determination device 300, if the ground clearance of said vehicle corresponds to the predetermined mine clearance for such a mine risk situation, and if the ground clearance does not correspond to said predetermined mine clearance, take action so as to facilitate adaption of the ground clearance so that the bottom portion of the vehicle body of the vehicle is raised to the predetermined distance from the ground, and thus such that a predetermined ground clearance of the vehicle is applied. Said action taking so as to facilitate adaption of the ground clearance may be any suitable action such as automatic adaption or alerting a vehicle operator that ground clearance adaption is required.

According to an aspect of the present disclosure, said mine safety arrangement A comprises a mine safety risk information device 400 configured to provide information if said vehicle is operating or is intended to operate in one or more of a zone, a region an area, and a situation where there is a risk for being subjected to mines, i.e. mine explosions. According to an aspect of the present disclosure, said control device 200 comprises or is operably connected to the mine safety risk information device 400. According to an aspect of the present disclosure, said control device 200 is configured to receive information of potential mine safety risk from said mine safety risk information device 400. Said mine safety risk information device 400 may comprise any suitable device for determining mine safety risk. Said mine safety risk information device 400 may comprise may comprise one or more devices for determining geographical location of said vehicle such as Global Navigation Satellite System, e.g. GPS, and/or communication devices for providing audible and/or visual information about mine safety risk.

According to an aspect of the present disclosure, said mine safety arrangement A comprises a sensor arrangement activation arrangement 500 configured to activate said sensor arrangement 100 based on information associated with said vehicle operating in an area where there may be a risk for mines. According to an aspect of the present disclosure, said control device 200 comprises or is operably connected to the sensor arrangement activation arrangement 500. According to an aspect of the present disclosure, said sensor arrangement activation arrangement 500 is configured to activate said sensor arrangement 100 based on information from said mine safety risk information device 400. According to an aspect of the present disclosure, said sensor arrangement activation arrangement 500 is configured to automatically activate said sensor arrangement 100 based on information associated with said vehicle operating in an area where there may be a risk for mines. According to an aspect of the present disclosure, said sensor arrangement activation arrangement 500 comprises an activation member such as an activation button or the like, where an operator associated with operation of the vehicle may activate said sensor arrangement 100 based on communicated information associated with said vehicle operating an area where there may be a risk for mines.

According to an aspect of the present disclosure, said sensor arrangement 100, when activated, is configured to emit signal(s) on said mine safe level L, where said mine safe level L is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

According to an aspect, said sensor arrangement 100, when activated, is configured to emit signal(s) on said mine safe level L, where said mine safe level is based on a predetermined ground clearance of said bottom portion and said predetermined distance from said floor portion.

According to an aspect, said sensor arrangement 100, when activated, is configured to emit signal(s) on said mine safe level L, where said predetermined distance from said floor portion of said mine safe level is based on the ground clearance of said bottom portion. According to an aspect of the present disclosure, should the current ground clearance be at a lower level, i.e. so that the bottom portion is closer to the ground than the predetermined ground clearance, said emitted signal(s) may, in order to provide said predetermined mine safe level, be at a distance further away from said floor so as to provide said mine safe level. Hereby warnings associated with body portions of persons within said space having crossed said mine safe level may be utilized as information of adapting the ground clearance.

According to an aspect of the present disclosure, the control device 200 comprises a memory arrangement comprising at least one memory. According to an aspect of the present disclosure, the control device 200 comprises a processor arrangement comprising at least one processor. According to an aspect of the present disclosure, the control device 200 comprises a communication arrangement comprising at least one communication unit.

According to an aspect of the present disclosure, the memory arrangement of the control device 200 may be integrated with or embedded into the processor arrangement, or be a separate memory hardware device. According to an aspect of the present disclosure, the memory arrangement of the control device 200 operably connectable to the processor arrangement. According to an aspect of the present disclosure, at least one of the at least one memory of the memory arrangement may be integrated with or embedded into the processor arrangement, and/or be a separate memory hardware device.

According to an aspect of the present disclosure, the memory arrangement may include a RAM, a ROM, a hard disk, an optical disk, a magnetic medium, a flash memory and/or any other mechanism capable of storing instructions or data.

According to an aspect of the present disclosure, the processor arrangement of the control device 200 may include any physical device having an electric circuit that performs logic operations on input data. According to an aspect of the present disclosure, the at least one processor of the processor arrangement of the control device 200 may include any physical device having an electric circuit that performs logic operations on input data. For example, the processor arrangement may include one or more integrated circuits, microchips, microcontrollers, microprocessors, all or part of a CPU, DSP, FPGA, or other circuits for executing instructions or performing logic operations.

Figure 4:
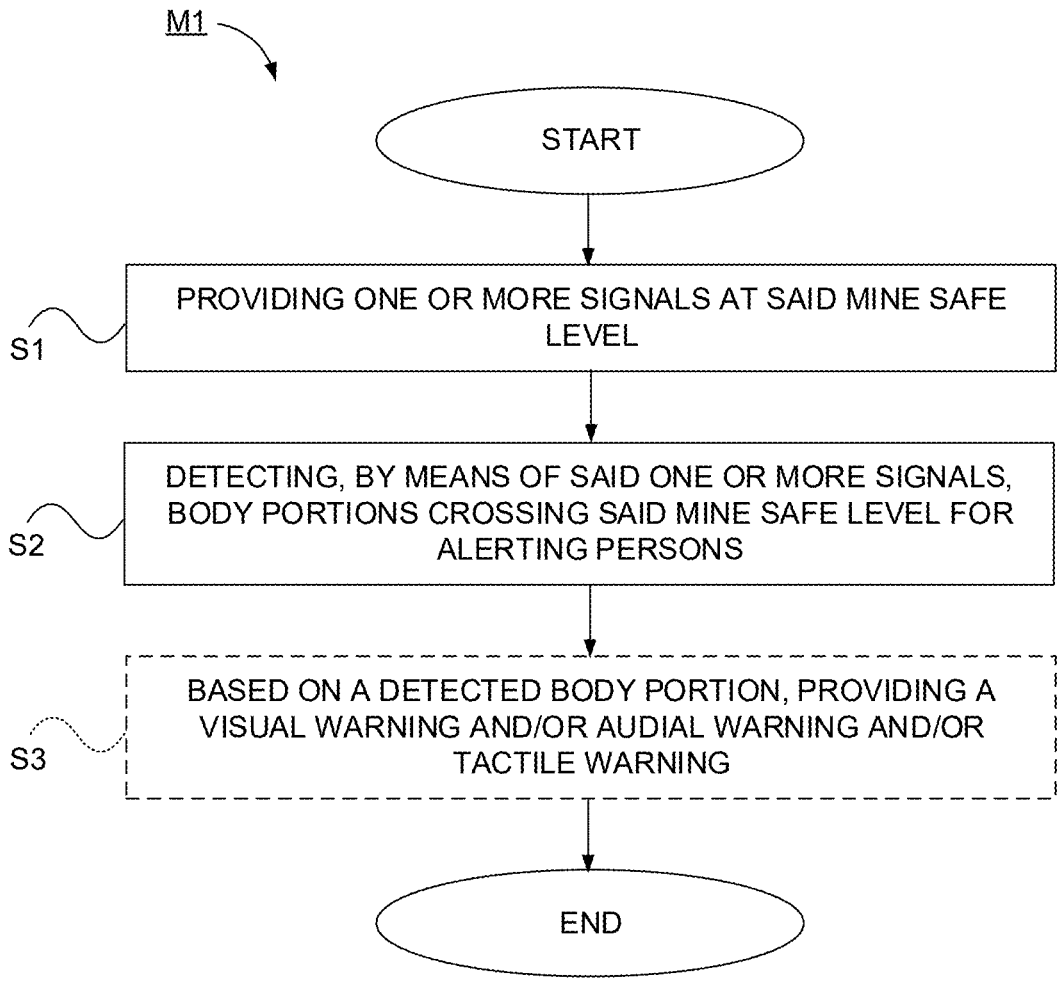

FIG. 4 schematically illustrates a flow chart of a method M1 for facilitating mine safe operation of a vehicle according to an aspect of the present disclosure.

Said vehicle body comprises a bottom portion and an inner space for housing passengers. Said inner space has a floor portion associated with said bottom portion. Said inner space comprises a mine safe level at a predetermined distance from said floor portion. Persons housed in said inner space and being positioned with all body portions at or above said mine safe level are expected to be safe should the vehicle be subjected to a mine under said bottom portion affecting said floor portion. Thus, persons housed in said inner space and being positioned with all body portions at or above said mine safe level are expected to be safe if the vehicle is subjected to a mine under said bottom portion affecting said floor portion.

According to the aspect the method M1 comprises a step S1. In this step, one or more signals are provided at said mine safe level.

According to the aspect the method M1 comprises a step S2. In this step, body portions crossing said mine safe level are detected by means of said one or more signals for alerting persons of the mine safety risk.

According to an aspect of the present disclosure, said method M1 may comprise a step S3. In this step a visual warning and/or an audial warning and/or a tactile warning is provided based on a detected body portion. In this step a visual warning and/or an audial warning and/or a tactile warning is provided based on if a body portion is detected by means of said one or more signals.

According to an aspect of the present disclosure, said step of providing a visual warning and/or an audial warning and/or a tactile warning based on a detected body portion is performed if said body portion has been detected during a predetermined time interval.

According to an aspect of the present disclosure, the method may comprise the steps of: if a body portion crossing said mine safe level is detected by means of said one or more signals, determining the time during which said body portion remains crossing said mine safe level, and, if said time exceeds a predetermined time interval, providing a visual warning and/or an audial warning and/or a tactile warning based.

According to an aspect of the present disclosure, said mine safe level is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

According to an aspect, said mine safe level is based on a predetermined ground clearance of said bottom portion and said predetermined distance from said floor portion. According to an aspect, said predetermined distance from said floor portion of said mine safe level is based on the ground clearance of said bottom portion. According to an aspect, said predetermined mine safe level is associated with the expected deformation of said bottom portion if a mine would explode underneath said bottom portion of said vehicle body.

The method M1 for facilitating mine safe operation of a vehicle is according to an embodiment adapted to be performed by the mine safety arrangement of a vehicle described above with reference to FIGS. 2 and 3.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications suited to the particular use contemplated.

The invention claimed is:

1. A mine safety arrangement of a vehicle, said vehicle comprising a vehicle body and a ground engaging arrangement comprising at least one of: track assemblies and a set of wheels, said ground engaging arrangement being connected to said vehicle body, said vehicle body comprising a bottom portion and an inner space for housing passengers, said inner space having a floor portion associated with said bottom portion, said inner space comprising a mine safe level at a predetermined distance from said floor portion, wherein said mine safe level is associated with an expected deformation of said bottom portion should the vehicle be subjected to a mine explosion under said bottom portion affecting said floor portion, wherein said mine safety arrangement comprises a sensor arrangement configured to provide one or more signals at said mine safe level so that body portions of persons housed in said inner space crossing said mine safe level are detected by said one or more signals for alerting said persons that said body portions crossed said mine safe level.

2. The mine safety arrangement of claim 1, wherein said one or more signals configured to be provided by said sensor arrangement are one or more light beams.

3. The mine safety arrangement of claim 2, wherein said one or more light beams are laser beams.

4. The mine safety arrangement of claim 1, wherein said sensor arrangement comprises at least one signal emitting unit arranged within said inner space so as to facilitate providing said one more signals at said mine safe level.

5. The mine safety arrangement of claim 1, further being configured to, based on a detected body portion, provide a visual warning and/or audial warning and/or tactile warning.

6. The mine safety arrangement of claim 1, wherein said mine safe level is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

7. A method for facilitating mine safe operation of a vehicle, said vehicle comprising a vehicle body and a ground engaging arrangement comprising at least one of: track assemblies and a set of wheels, said ground engaging arrangement being connected to said vehicle body, said vehicle body comprising a bottom portion and an inner space for housing passengers, said inner space having a floor portion associated with said bottom portion, said inner space comprising a mine safe level at a predetermined distance from said floor portion, wherein said mine safe level is associated with an expected deformation of said bottom portion should the vehicle be subjected to a mine explosion under said bottom portion affecting said floor portion, said method comprising the steps of:

providing one or more signals at said mine safe level; and, detecting, by said one or more signals, body portions of persons housed in said inner space crossing said mine safe level for alerting said persons that said body portions crossed said mine safe level.

8. The method of claim 7, wherein said one or more signals are one or more light beams.

9. The method of claim 8, wherein said one or more light beams are laser beams.

10. The method of claim 7, the method further comprising the step of, based on a detected body portion, providing a visual warning and/or an audial warning and/or a tactile warning.

11. The method of claim 7, wherein said mine safe level is a predetermined level determined based on: mine tests performed on one or more of: a corresponding vehicle, a corresponding vehicle body and a corresponding bottom portion, and/or based on: mine simulations and/or estimations and/or calculations based on one or more of: configuration of such a vehicle, configuration of such a vehicle body and configuration of such a bottom portion.

* * * * *